US005238060A

United States Patent [19]

Niehaus et al.

[11] Patent Number: 5,238,060

[45] Date of Patent: Aug. 24, 1993

[54] SAMPLING PUMP WITH PACKER

[75] Inventors: K. Lynn Niehaus, Manchester; David A. Fischer, Ann Arbor, both of Mich.

[73] Assignee: OED Environmental Systems, Inc., Ann Arbor, Mich.

[21] Appl. No.: 941,693

[22] Filed: Sep. 8, 1992

[51] Int. Cl.[5] ..... E21B 49/00

[52] U.S. Cl. ..... 166/68

[58] Field of Search ..... 166/64, 68, 105; 73/302, 864.34; 417/394, 392

[56] References Cited

U.S. PATENT DOCUMENTS

| | | | |
|---|---|---|---|
| 4,257,751 | 3/1981 | Kofahl . | |
| 4,489,779 | 12/1984 | Dickinson et al. . | |
| 4,585,060 | 4/1986 | Bernardin et al. | 166/68 X |
| 4,727,936 | 3/1988 | Mioduszewski et al. | 166/68 X |
| 5,040,608 | 8/1991 | Doan | 166/68 X |
| 5,103,179 | 4/1992 | Thomas et al. . | |

*Primary Examiner*—Thuy M. Bui

*Attorney, Agent, or Firm*—Harness, Dickey & Pierce

[57] ABSTRACT

There is provided a fluid sampling apparatus for withdrawing samples of groundwater or other fluids from a well or other monitoring site. The apparatus preferably includes pump means, packer means, conduit means and a wellhead assembly that are permanently installed at the well or monitoring site and are thereby dedicated thereto in order to avoid or minimize cross-contamination of samples from site to site. The packer is integral with the pump and isolates the groundwater below the packer in order to minimize the amount of groundwater which must be pumped in order to purge the well prior to taking an acceptable sample. The apparatus preferably also includes a removable and portable controller means adapted for easy and convenient transportation and connection to such dedicated fluid sampling components at various wells or monitoring sites.

16 Claims, 3 Drawing Sheets

SAMPLING PUMP WITH PACKER

FIELD OF THE INVENTION

The present invention relates to an apparatus for obtaining liquid samples from a well or the like. More particularly, the present invention relates to an apparatus for obtaining liquid samples which minimizes the amount of liquid which must be purged from the well prior to obtaining an acceptable sample.

BACKGROUND AND SUMMARY OF THE INVENTION

Recent increases in public concern for the environment have resulted in various government imposed environment regulations. Among such regulations are requirements relating to the monitoring of groundwater quality. In response to these requirements, water quality analytic capabilities have been improved and water sampling equipment has been developed. Much of the previously developed sampling equipment has not been effective, however, in obtaining consistent, non-contaminated water samples that are accurately representative of the water system from which the sample is taken.

The inadequacies of the previous sampling equipment stem largely from such causes as cross-contamination between sampling sites, ineffective and inconsistent field cleaning methods, contamination due to equipment handling, and inconsistent well depth sampling. In addition to presenting sample quality problems, much of the previous equipment has been heavy and bulky and thus difficult to transport from one monitoring site to another. Another problem associated with the previous sampling equipment is the amount of time it takes to obtain an acceptable sample. Prior to accepting a sample, the well must be purged 3 to 5 times. Depending on the size of the well, the depth of the groundwater in the well and the size of the pump, an excessive amount of time can be required to obtain an acceptable groundwater sample. Finally, much of such previous equipment has proved to be complicated to operate, inordinately expensive, and impractical for sampling at remote locations where site access is severely limited.

In accordance with the present invention, a fluid sampling apparatus is provided for use in obtaining accurate samples of groundwater or other fluids. In the preferred embodiment, the pump is dedicated to a particular monitoring well or other sampling site in order to substantially avoid cross-contamination of samples from site to site and is constructed from light weight non-contaminating materials. A packer, associated with the pump, is provided for the fluid sample apparatus which minimizes the amount of liquid which must be pumped to purge the well prior to obtaining an acceptable sample.

A fluid sampling pump for use in conjunction with the present invention to which a packer is added to reduce the amount of liquid which must be purged prior to sampling is disclosed in U.S. Pat. No. 4,489,779 issued Dec. 25, 1984 to Dickinson et al. and U.S. Pat. No. 4,585,060 issued Apr. 29, 1986 to Bernardin et al. The disclosures of which are hereby incorporated by reference.

The preferred sampling pump is a submersible, fluid actuated pump wherein the actuating fluid is preferably a gas. A first flexible bladder member separates and isolates the interior of the pump into two chambers; a first chamber that contains the sample fluid and is in communication with both the pump inlet and outlet and a second chamber that surrounds the first chamber with the first bladder disposed therebetween. The second chamber is connected to a source of actuating gas. A second flexible bladder member, or packer, forms a third chamber that surrounds the second chamber with the outside wall of the pump disposed therebetween. The third chamber is also connected to a source of actuating gas. The sample liquid is conveyed through the pump by first pressurizing the third chamber to expand the second bladder member. This separates the groundwater within the monitoring well or other sampling site into two regions, with the region below the second bladder member being in communication with the first chamber of the pump. The pump is then actuated by alternately pressurizing and venting or relieving the pressure in the second chamber of the pump to contract and relax the first bladder member thus alternately decreasing and increasing the volume of the first chamber. Sample fluid is drawn into the first chamber from the region below the second bladder member during such increases in volume under the influence of the natural hydrostatic head of the groundwater and is discharged through the pump outlet during such decrease in volume, thereby conveying the sample fluid through the pump. The second bladder member thus minimizes the amount of groundwater which must be pumped in order to purge the well prior to accepting a sample. This is accomplished by isolating the intake to the first chamber from the total volume of fluid in the monitoring well or other sampling site. The components of the pump and packer are preferably composed of low cost, light weight synthetic materials that are non-corrosive and do not otherwise affect the chemical composition of the sampled fluid.

The sampling pump with the integral packer is preferably dedicated to, and thus remains in, a particular sampling site or well without fluid pressure supplied to either the second or third chamber. The sampling site or well is substantially isolated from the above-ground surroundings by a wellhead assembly in order to reduce potential contamination during sampling. A portable controller apparatus is provided with quick-disconnect means and includes means for pressurizing the third chamber and means for alternately pressurizing and de-pressurizing the actuating fluid in the second chamber. The fluid sampling apparatus may also optionally include means for measuring the standing level of the fluid in the well.

Additional advantages and features of the present invention will become apparent from the following description and the appended claims taken in conjunction with the accompanying drawings.

DETAILED DESCRIPTION OF THE PREFERRED EMBODIMENT

Figures 1, 2, 3:
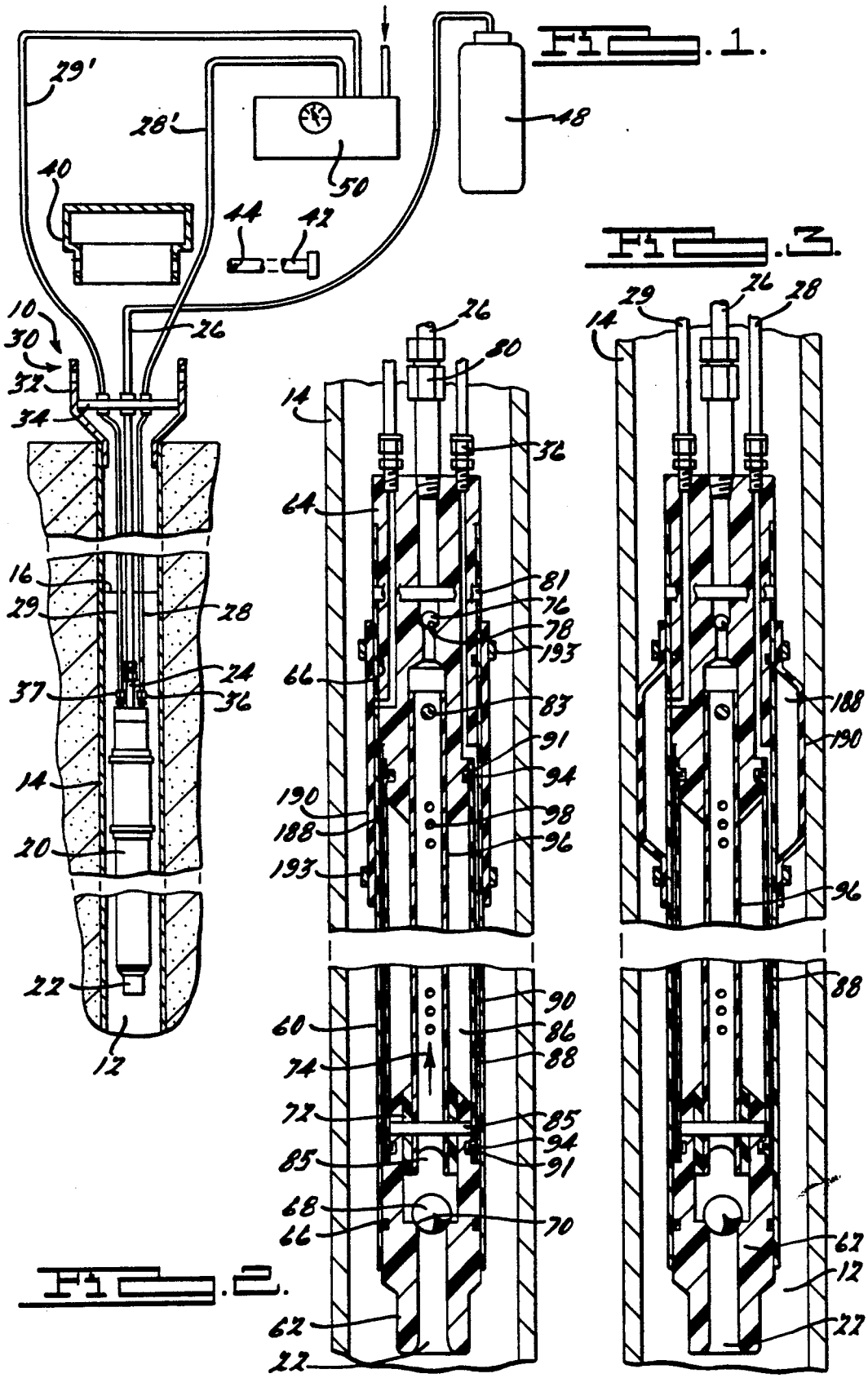
FIG. 1 is a partially exploded, longitudinal sectional view of a fluid sampling system in accordance with the present invention.
FIG. 2 is an enlarged longitudinal cross-sectional view of the fluid sampling pump of FIG. 1.
FIG. 3 is an enlarged longitudinal cross-sectional view similar to FIG. 2 but showing the packer in its inflated state.

For purposes of illustration, FIGS. 1 through 7 of the drawings depict exemplary embodiments of a fluid sampling apparatus according to the present invention as installed in a monitoring well for withdrawing samples of groundwater. One skilled in the art will readily recognize from the following discussions that the principles of the invention are equally applicable to fluid sampling apparatus other than that shown in the drawings as well as to other fluid pumping apparatus.

In FIG. 1, an exemplary fluid sampling apparatus according to the present invention is indicated generally by reference numeral 10 and is shown for purposes of illustration as installed in a monitoring well 12, which preferably includes a well casing 14. A fluid sampling pump 20 is disposed within the well casing 14 of the monitoring well 12 and is submerged beneath the water level of the groundwater 16 to a suitable depth for obtaining accurate and representative groundwater samples.

As is explained in further detail below, the preferred fluid sampling pump 20 is a fluid-actuated pump, wherein the actuating fluid is preferably a gas such as air, for example, and includes an inlet port 22 and an outlet port 24. A wellhead assembly 30 is secured to the well casing 14 and includes a wellhead body portion 32 having a generally horizontal support plate 34 therein. The body portion 32 substantially isolates the interior of the well 12 from the above ground surrounding environment in order to avoid or at least minimize contamination of the interior of the well which would result from contact between the groundwater 16 and the air or other elements. The wellhead assembly 30 also includes a groundwater conduit 26 sealingly connected at one end to the pump outlet 24 and passing through plate 34 to provide direct sample delivery to sample collection vessel 48. A pumping gas conduit 28 is connected at one end to a pumping gas connection 36 on pump 20 and at the other end to the support plate 34. An inflation gas conduit 29 is connected at one end to an inflation gas connection 37 on pump 20 and at the other end to the support plate 34. Because the pump is preferably of a lightweight construction, the conduits may also be used to retain the pump in its submerged position in the well.

A controller apparatus, which is described in further detail in the disclosures of U.S. Pat. Nos. 4,489,779 and 4,585,060 as well as below, is selectively and removably connected to the wellhead assembly 30 by means of external gas conduits 28' and 29'. The preferred controller apparatus 50 is a portable, lightweight unit and includes a source of actuating gas and means for positively pressurizing the packer of the fluid sampling pump 20 and means for alternately positively pressurizing and venting or relieving the pressure of the actuating gas to operate the fluid sampling pump 20 as is explained below.

In order to further isolate the interior of the well 12 from above ground contamination, the wellhead assembly 30 preferably includes a closure member 40 adapted to be secured to the body portion 32 by a locking pin 42 insertable through corresponding aligned apertures in the body portion 32 and in the closure member 40. The locking pin 42 preferably includes an aperture 44 at one end, through which a padlock or other suitable locking means may be inserted in order to substantially prevent unauthorized access to the interior portions of the wellhead assembly.

Referring to FIG. 2, the fluid sampling pump 20 includes a generally hollow cylindrical pump body 60 having an inlet cap 62 and an outlet cap 64. The inlet and outlet caps 62 and 64, respectively, are sealed to the pump body 60 by means of O-rings 66 or other suitable sealing means known to those skilled in the art. The inlet cap 62 includes the inlet port 22 and check valve means for preventing backflow of groundwater or other fluids through the inlet port 22 from the interior of the pump 20. Such check valve means includes a ball 68 trapped between a ball seat 70 and a retainer 72. Retainer 72 has a plurality of scallops 85 which allow for the flow of groundwater into the pump when the ball 68 is positioned against retainer 72. Thus, when groundwater is flowing properly through the pump in the direction indicated by flow arrows 74, the groundwater flows around the ball 68 and through the scallops 85 in retainer 72 into the interior of the pump 20. Backflow in a direction opposite that indicated by flow arrows 74 is substantially prevented by sealing engagement of the ball 68 with its ball seat 70. Similarly, the outlet cap 64 includes check valve means comprising ball 76 trapped between ball seat 78 and outlet fitting 80. Thus, flow through the pump in the direction indicated by flow arrows 74 is allowed to pass around the ball 76 and through the outlet fitting 80. Back flow is substantially prevented, however, by sealing engagement of the ball 76 with its ball seat 78.

The interior of the pump body 60 is divided and isolated into two chambers by a generally cylindrical flexible bladder 90. The bladder 90 defines a groundwater chamber 86 in its interior and defines an annular gas chamber 88 between the bladder exterior and the interior wall surface of the pump body 60. The bladder 90 is sealingly connected to the inlet and outlet caps 62 and 64, respectfully, at its opposite ends by means of rings 94 which are swaged or otherwise deformed to sealingly force the bladder material into the grooves 91 on the inlet and outlet caps 62 and 64. The rings 94 may be composed of a soft ductile metal or other readily deformable materials known to those skilled in the art. A connecting tube 96 in the groundwater chamber 86 extends between inlet 62 and retainer member 72 and includes a number of apertures 98 spaced at various locations along its longitudinal length in order to allow the free flow of groundwater fluid between the interior of the connecting tube 96 and the remainder of the groundwater chamber 86.

Sampling pump 20 is held together by three dowel pins 81, 83 and 85. Dowel pin 81 is nearest the top of pump 20 and extends through pump body 60 and outlet cap 64 to secure pump body 60 to outlet cap 64. Dowel pin 81 also acts as a stop for ball 76 thus trapping ball 76 between ball seat 78 and outlet fitting 80. Dowel pin 83 is located near the upper end of connecting tube 96 and secures connecting tube 96 to outlet cap 64. The third dowel pin 85 is located near the lower end of connecting tube 96 and secures inlet cap 62 to connecting tube 96 as well as retainer 72 to inlet cap 62. Dowel pin 85 also acts as a stop for ball 68 thus trapping ball 68 between ball seat 70 and retainer 72 and prohibiting ball 68 from traveling up into connecting tube 96.

The exterior of the pump body 60 has a second generally cylindrical flexible bladder 190 sealingly connected to pump body 60 at its opposite ends by means of rings 193 which are swaged or otherwise deformed to sealingly force the bladder material against the exterior surface of pump body 60. The rings 193 may be composed of a soft ductile metal or other readily deformable materials known to those skilled in the art. The second bladder 190 defines a third annular gas chamber 188 between the bladder interior and the exterior wall surface of pump body 60.

Referring to FIGS. 1 through 3, the fluid sampling pump 20 is activated by means of an actuating gas being supplied to gas chamber 188 through conduit 29. This actuating gas causes the second bladder 190 to expand and make sealing contact with the interior wall of well casing 14. The expansion of second bladder 190 divides the groundwater present in the well casing 14 into and upper and lower region. In order for the well to be purged, the fluid sampling pump 20 only needs to pump the water contained in the lower region beneath second bladder 190, thus significantly reducing the amount of groundwater which must be pumped prior to acceptance of a groundwater sample.

The actuation of fluid sampling pump 20 continues by means of an actuating gas supplied to the gas chamber 88 through conduit 28 which is alternately subjected to positive and negative or reduced pressures. The alternate pressurizing and depressurizing of the actuating gas in gas chamber 88 causes the bladder 90 to alternately contract and relax, thus alternately decreasing and increasing the volume of the groundwater chamber 86. During such increases in volume, groundwater is drawn from the well 12 into the groundwater chamber 86 through the inlet port 22 in the inlet cap 62. During such decreases in such volume, the groundwater is forced out of groundwater chamber 86 through outlet port 24 in the outlet cap 64 and is passed through the groundwater conduit 26 to be collected in the sample collection vessel 48. The check valve means in each of the inlet and outlet caps 62 and 64 prevents the groundwater from being discharged through the inlet port or drawn in through the outlet port. The capacity of the pump 20 may be changed by increasing the length of pump body 60, and correspondly increasing the length of bladder 90 and connecting tube 96, thereby changing the amount of groundwater drawn in and forced out during the alternate contractions and relaxations of the flexible bladder 90.

It should be noted that except for the swaged rings 94 and 193, the various components of the pump and the packer are preferably composed of relatively lightweight and low cost synthetic materials that will not corrode when exposed to the groundwater 16 and will not otherwise affect the composition of the groundwater flowing through the pump. Examples of such materials include rigid polyvinyl chloride (PVC) or virgin grade tetrafluoroethylene (TFE) teflon. The flexible bladders are preferably composed of a flexible synthetic material which also will not corrode or affect the composition of groundwater flowing therethrough such as flexible polyvinyl chloride, TFE, or VITON, for example. VITON is a trademark owned by E.I. DuPont de Nemours & Company for its fluoro-elastomer materials. One skilled in the art will readily recognize, however, that the various components of the fluid sampling apparatus may be composed of other suitable non-corrosive materials.

Figure 4:
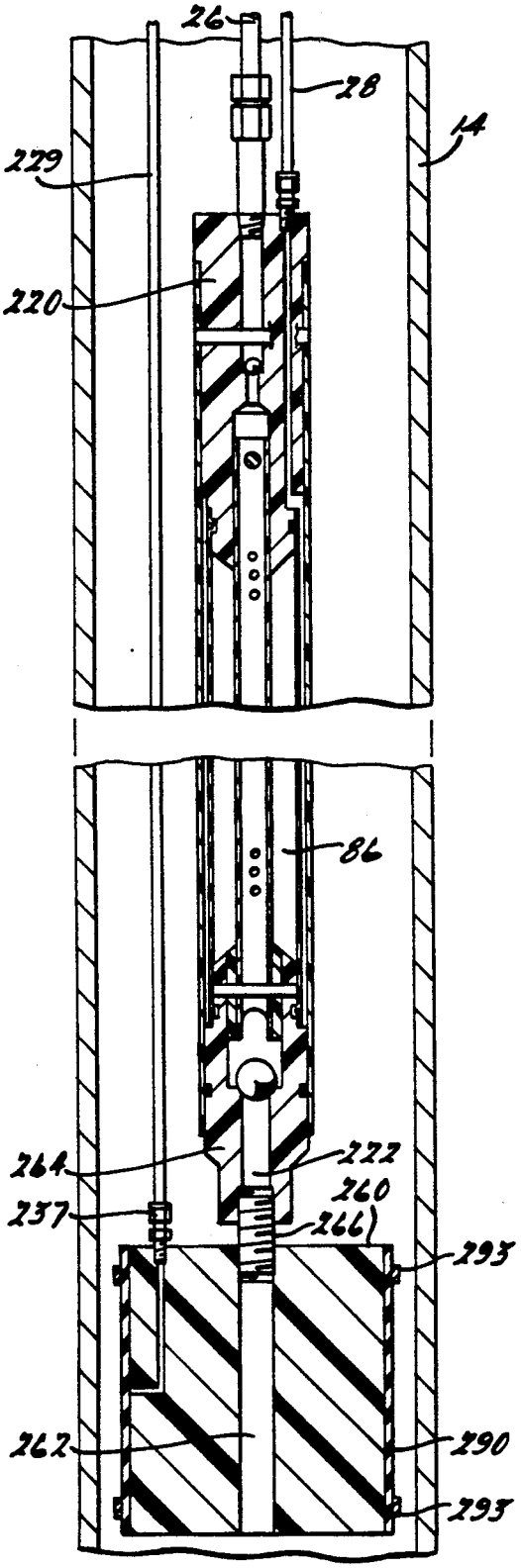
FIG. 4 is an enlarged longitudinal cross-sectional view similar to that of FIG. 2 but showing another embodiment of the present invention.
Figure 5:
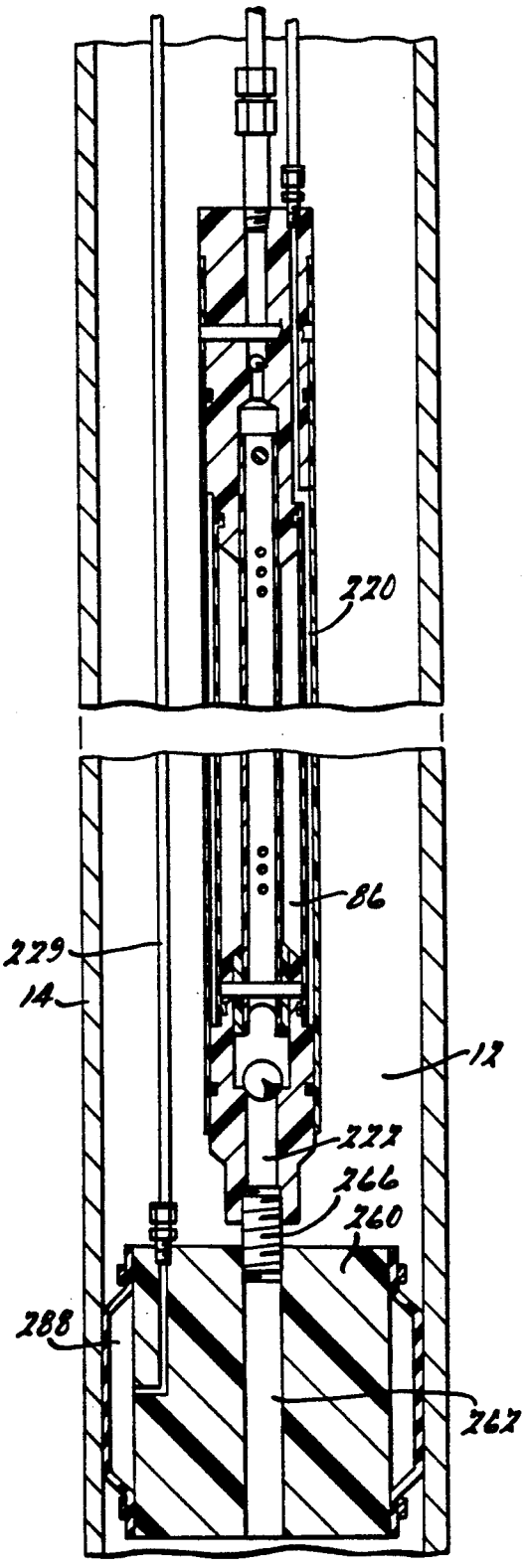
FIG. 5 is an enlarged longitudinal cross-sectional view similar to FIG. 4 but showing the packer in its inflated state.

FIGS. 4 and 5 show another embodiment of the present invention. The fluid sampling pump 220 of this embodiment is identical to the fluid sampling pump 20 of the embodiment shown in FIGS. 1–3 with the exception of the location of the integral packer. Components which are identical to the corresponding components shown in FIGS. 1–3 will have the same reference numerals in FIGS. 4 and 5.

On applications where the outside diameter of the sampling pump 220 is significantly smaller than the inside diameter of the well casing 14 it is not feasible to expand a bladder from the outside of the sampling pump 220 to the inside of the well casing 14. This embodiment is designed for the above type of applications.

A packer body 260 is disposed below the sampling pump 220 and has an inlet passage 262 extending completely through it. The end of inlet passage 262 adjacent to sampling pump 220 is fixedly secured to inlet cap 264 by a connecting tube 266 such that the ground water below the packer body 260 is in communication with groundwater chamber 86 via inlet port 222, connecting tube 266 and inlet passage 262. Connecting tube 266 is secured to both inlet cap 264 and packer body 260 by a threadable connection or other means known by those skilled in the art. The connecting tube 266 supports the weight of the packing apparatus.

The exterior of the packer body 260 has a generally cylindrical flexible bladder 290 sealingly connected to packer body 260 at its opposite ends by means of rings 293 which are swaged or otherwise deformed to sealingly force the bladder material against the exterior surface of packer body 260. The rings 293 may be composed of a soft ductile metal or other readily deformable materials known to those skilled in the art. The bladder 290 defines an annular gas chamber 288 between the bladder interior and exterior wall surface of packer body 260. An inflation gas conduit 229 is connected at one end to an inflation gas connection 237 on packer body 260 and at the other end to the support plate 34. The conduit 229 may also be used to help support the weight of the packer apparatus.

Referring to FIGS. 4 and 5, the fluid sampling pump 220 is first actuated by means of an actuating gas being supplied to gas chamber 288 through conduit 229. This actuating gas causes the bladder 290 to expand and make sealing contact with the interior wall of well casing 14. The expansion of bladder 290 divides the groundwater present in the well casing 14 into an upper and lower region. In order for the well to be purged, the fluid sampling pump 220 only needs to pump the water contained in the lower region beneath the packer body 260, thus significantly reducing the amount of groundwater which must be pumped prior to acceptance of a groundwater sample.

The actuation of pump 220 after inflation of the packer is identical to the actuation described above for pump 20 in the embodiment shown in FIGS. 1 through 3. The groundwater is drawn from the well 12 into the groundwater chamber 86 through the inlet passage 262, through the connecting tube 266 and through the inlet port 222.

Figure 6:
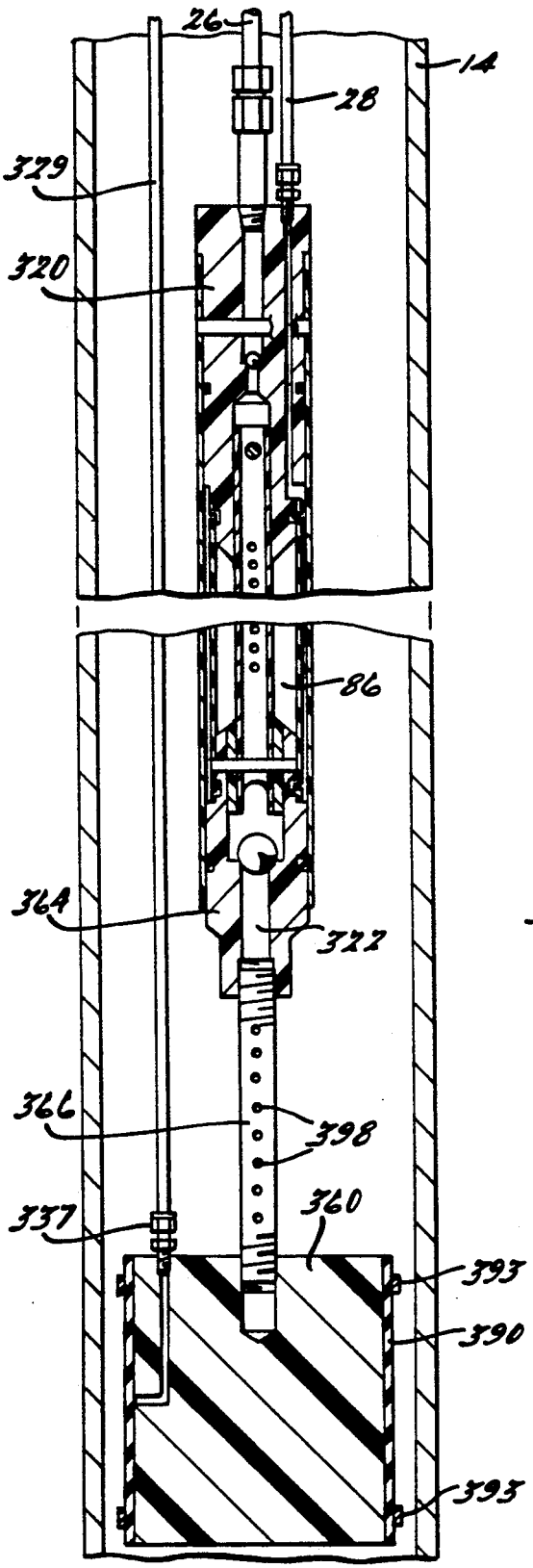
FIG. 6 is an enlarged longitudinal cross-sectional view similar to that of FIG. 2 but showing another embodiment of the present invention.
Figure 7:
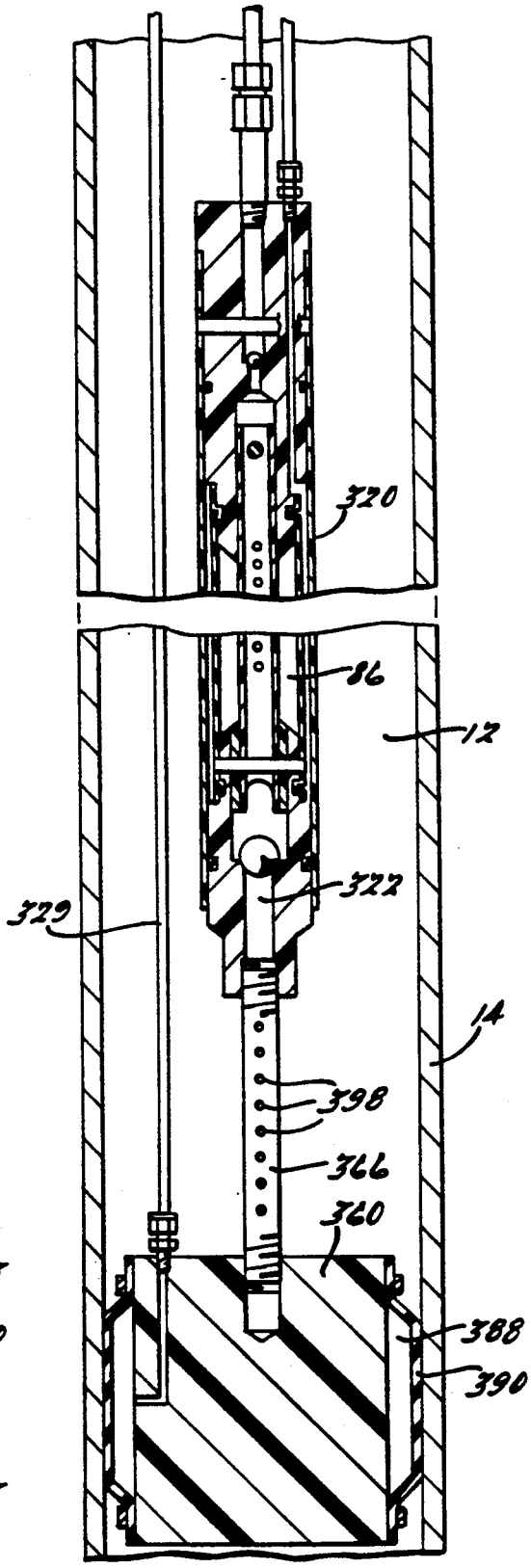
FIG. 7 is an enlarged longitudinal cross-sectional view similar to FIG. 4 but showing the packer in its inflated state.

FIGS. 6 and 7 show another embodiment of the present invention. The fluid sampling pump 320 of this embodiment is identical to the fluid sampling pump 20 of the embodiment shown in FIGS. 1-3 with the exception of the location of the integral packer. Components which are identical to the corresponding components shown in FIGS. 1-3 will have the same reference numerals in FIGS. 6 and 7.

Again, on applications where the outside diameter of the sampling pump 320 is significantly smaller than the inside diameter of the well casing 14 it is not feasible to expand a bladder from the outside of the sampling pump 320 to the inside of the well casing 14. This embodiment is designed for the above applications.

A packer body 360 is disposed below the sampling pump 320. The packer body 360 is fixedly secured to inlet cap 364 by a connecting tube 366. Connecting tube 366 is secured to both inlet cap 364 and packer body 360 by a threadable connection or other means known by those skilled in the art. Connecting tube 366 supports the weight of the packing apparatus. Connecting tube 366 has a plurality of holes 398 spaced at various locations along its longitudinal length in order to allow the free flow of groundwater fluid between the interior of the connecting tube 366 and the interior of the well casing 14. Thus, groundwater above the packer body 360 is in communication with groundwater chamber 86 via inlet port 322 of inlet cap 364, connecting tube 366 and the plurality of holes 398.

The exterior of the packer body 360 has a generally cylindrical flexible bladder 390 sealingly connected to packer body 360 at its opposite ends by means of rings 393 which are swaged or otherwise deformed to sealingly force the bladder material against the exterior surface of packer body 360. The rings 393 may be composed of a soft ductile metal or other readily deformable materials known to those skilled in the art. The bladder 390 defines an annular gas chamber 388 between the bladder interior and exterior wall surface of packer body 360. An inflation gas conduit 329 is connected at one end to an inflation gas connection 337 on packer body 360 and at the other end to the support plate 34. The conduit 329 may also be used to help support the weight of the packer apparatus.

Referring to FIGS. 6 and 7, the fluid sampling pump 320 is first actuated by means of an actuating gas being supplied to gas chamber 388 through conduit 329. This actuating gas causes the bladder 390 to expand and make sealing contact with the interior wall of well casing 14. The expansion of bladder 390 divides the groundwater present in the well casing 14 into an upper and lower region. In order for the well to be purged, the fluid sampling pump 320 only needs to pump the water contained in the upper region above the packer body 360, thus significantly reducing the amount of groundwater which must be pumped prior to acceptance of a groundwater sample.

The actuation of pump 320 after inflation of the packer is identical to the actuation described above for pump 20 in the embodiment shown in FIGS. 1 through 3. The groundwater is drawn from the well 12 into the groundwater chamber 86 through the plurality of holes 398, through the connecting tube 366 and through the inlet port 322.

The preferred controller apparatus 50 is identical for each of the embodiments described above and generally includes the external gas conduits 28' and 29', means for supplying an actuating gas to gas chamber 188, 288 or 388 of the packer and means for supply an actuating gas to gas chamber 88 of the pump 20, 220 or 320 and for alternately pressurizing and venting, or relieving, the pressure of the actuating gas to gas chamber 88 as described above in order to actuate the fluid sampling pump. The various physical components of the preferred controller apparatus 50 are well known to those skilled in the art and thus are described only schematically in the disclosure of U.S. Pat. Nos. 4,489,779 and 4,585,060 in terms of their functions with the exception of the supply of actuation gas to the packer. A person skilled in the art can easily connect the actuating gas source 124 to the external supply line 29' and provide a simple on/off switch for expanding bladders 190, 290 or 390.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

What is claimed is:

1. A groundwater sampling apparatus for withdrawing groundwater samples from a groundwater monitoring well, said apparatus having dedicatable inground components to prevent the apparatus from contaminating another well, said apparatus comprising:

a pump adapted to be submerged in the groundwater within said well for pumping a portion of said groundwater therefrom, said pump being permanently dedicatable to said well and having a groundwater chamber with an inlet and an outlet; said groundwater chamber being in communication with said portion of said groundwater in said well through said inlet when said pump is submerged in said groundwater;

a packer associated with said pump, said packer reducing the volume of said portion of said groundwater which needs to be pumped in order to purge said well by isolating said portion of said groundwater; and a wellhead assembly permanently dedicatable to said well and adapted to be secured to said well to isolate the interior of said well from the above-ground surroundings, said wellhead assembly further including first conduit means communicable with said pump and said wellhead assembly, and second conduit means communicable with said packer and said wellhead assembly.

2. The groundwater sampling apparatus of claim 1 wherein said packer comprises:

a flexible bladder sealingly attached to said pump, said flexible bladder defining a gas chamber between said pump and said flexible bladder.

3. The groundwater sampling apparatus of claim 1 wherein said packer comprises:

a packer body secured to said pump, said packer body defining a fluid inlet passage extending completely through said packer body, said fluid inlet passage being in communication with said inlet of said pump and with said portion of said groundwater in said well; and a flexible bladder sealing attached to said packer body, said flexible bladder defining a gas chamber between said packer body and said flexible bladder.

4. The groundwater sampling apparatus of claim 1 wherein said packer comprises:

a hollow cylindrical tube fixedly attached to said inlet of said pump, said hollow cylindrical tube fixedly attached to said inlet of said pump, said hollow cylindrical tube having a plurality of holes extending completely through said cylindrical tube, said inlet of said pump being in communication with said portion of said groundwater in said well through said plurality of holes when said pump is submerged in said groundwater;

a packer body fixedly secured to said cylindrical tube; and a flexible bladder sealingly attached to said packer body, said flexible bladder defining a gas chamber between said packer body and said flexible bladder.

5. A groundwater sampling apparatus for withdrawing groundwater samples from a groundwater monitoring well, said apparatus having dedicatable inground components to prevent the apparatus from contaminating another well, said apparatus including a gas-actuated water sampling pump having an inlet, an outlet and a first gas chamber for receiving a gas therein, a gas-actuated packer associated with said pump, said packer having a second gas chamber for receiving gas therein, and a controller selectively communicable with said sampling pump and said packer, said controller including:

a source of said gas under pressure;

first valve means connected to said source of said gas and being actuable into a pressurizing mode to provide gas communication between said source of said gas and said first gas chamber of said sampling pump and actuable into a relief mode to provide gas communication between said gas chamber and a region having a pressure lower than that of said source;

second valve means connected to said source of said gas and being actuable into a pressurizing mode to provide gas communication between said source of said gas and said second gas chamber of said packer; and pneumatic timing control means for selectively actuating said first valve means into a pressurizing mode for a first predetermined time period and actuating said first valve means into a relief mode for a second predetermined time period, thereby causing the pressure of said gas in said first gas chamber to be alternately raised and lowered;

said controller systems being portable so as to be selectively connectable to and disconnectable from said sampling pump in said monitoring well or to a correlative dedicated inground sampling pump in similar monitoring wells.

6. The groundwater sampling apparatus of claim 5 wherein said gas-actuated packer comprises:

a flexible bladder sealingly attached to said pump, said flexible bladder defining said second gas chamber between said pump and said flexible bladder.

7. The groundwater sampling apparatus of claim 5 wherein said packer comprises:

a packer body secured to said pump, said packer body defining a fluid inlet passage extending completely through said packer body, said fluid inlet passage being in communication with said inlet of said pump and with said portion of said groundwater in said well; and a flexible bladder sealingly attached to said packer body, said flexible bladder defining a gas chamber between said packer body and said flexible bladder.

8. The groundwater sampling apparatus of claim 5 wherein said packer comprises:

a hollow cylindrical tube fixedly attached to said inlet of said pump, said hollow cylindrical tube fixedly attached to said inlet of said pump, said hollow cylindrical tube having a plurality of holes extending completely through said cylindrical tube, said inlet of said pump being in communication with said portion of said groundwater in said well through said plurality of holes when said pump is submerged in said groundwater;

a packer body fixedly secured to said cylindrical tube; and a flexible bladder sealingly attached to said packer body, said flexible bladder defining a gas chamber between said packer body and said flexible bladder.

9. A groundwater sampling apparatus for withdrawing groundwater samples from a groundwater monitoring well, said apparatus having dedicatable inground components to prevent the apparatus from contaminating other monitoring wells, said apparatus having a gas-actuated water sampling pump for said groundwater monitoring well, said water sampling pump having an inlet, an outlet and a first gas chamber for receiving a gas therein, said apparatus further having a gas-actuated packer associated with said pump, said packer having a second gas chamber for receiving gas therein, said apparatus further having a controller system for controlling pressurization of gas in said first and second gas chambers, said water sampling pump being substantially installed in, and dedicated to, said groundwater monitoring well, said controller system being portable and being selectively connectable to, and disconnectable from said water sampling pump or to correlative dedicated inground sampling pumps in similar groundwater monitoring wells, said controller system including:

a source of said gas under pressure;

means for communicating said source of said gas to said first and second gas chambers, and means for selectively operating said last mentioned means to cause the pressure of said gas in said first chamber to be alternately raised and lowered.

10. The groundwater sampling apparatus of claim 9 wherein said gas-actuated packer comprises:

a flexible bladder sealingly attached to said pump, said flexible bladder defining said second gas chamber between said pump and said flexible bladder.

11. The groundwater sampling apparatus of claim 9 wherein said packer comprises:

a packer body secured to said pump, said packer body defining a fluid inlet passage extending completely through said packer body, said fluid inlet passage being in communication with said inlet of said pump and with said portion of said groundwater in said well; and a flexible bladder sealingly attached to said packer body, said flexible bladder defining said second gas chamber between said packer body and said flexible bladder.

12. The groundwater sampling apparatus of claim 9 wherein said packer comprises:

a hollow cylindrical tube fixedly attached to said inlet of said pump, said hollow cylindrical tube fixedly attached to said inlet of said pump, said hollow cylindrical tube having a plurality of holes extending completely through said cylindrical tube, said inlet of said pump being in communication with said portion of said groundwater in said well through said plurality of holes when said pump is submerged in said groundwater;

a packer body fixedly secured to said cylindrical tube; and a flexible bladder sealingly attached to said packer body, said flexible bladder defining a gas chamber between said packer body and said flexible bladder.

13. A groundwater sampling apparatus for withdrawing groundwater samples from a groundwater monitoring well, said apparatus having dedicatable inground components to prevent the apparatus from contaminating similar groundwater monitoring wells, said apparatus comprising:

a gas-actuated pump adapted to be submerged in the groundwater within said well for pumping a portion of said groundwater therefrom, said pump being substantially permanently installable in, and dedicatable to, said well and having a pump body portion including a first gas chamber, a groundwater chamber having an inlet and an outlet, and a flexible bladder for isolating said first gas chamber from said groundwater chamber, said groundwater chamber being in communication with said groundwater in said well through said inlet when said pump is submerged therein, substantial portions of said pump, including said pump body portion and said flexible bladder being composed of a polymeric material;

a gas actuated packer associated with said pump, said packer reducing the volume of said portion of said groundwater which needs to be pumped in order to purge said well by isolating said portion of said groundwater, said packer having a second gas chamber for receiving gas therein, said gas-actuated packer being composed of a polymeric material; and a wellhead assembly substantially permanently installable on, and dedicatable to said well and including a wellhead body portion adapted to be secured to said well to isolate the interior of said well from the above-ground surroundings, said wellhead assembly further including a first gas conduit having one end sealingly connected to said first gas chamber and an opposite end fixedly and sealingly connected to said wellhead body portion, a second gas conduit having one end sealingly connected to said second gas chamber and an opposite end fixedly and sealingly connected to said wellhead body portion, a groundwater conduit having one end sealingly connected to said outlet of said groundwater chamber and substantially uninterruptedly passing through said wellhead assembly to an opposite end in communication with the above-ground surroundings for collecting a sample quantity of said groundwater from said well; and controller apparatus including means selectively connectable to, and disconnectable from, said wellhead assembly and in fluid communication with said first and second gas conduits for supplying an actuating gas to said first and second gas chambers, said first gas chamber of said pump having the pressure of said actuating gas in said first gas chamber alternately pressurized and relieved in order to cause said bladder to alternately contract and relax to actuate said pump.

14. The groundwater sampling apparatus of claim 13 wherein said gas-actuated packer comprises:

a flexible bladder sealingly attached to said pump, said flexible bladder defining said second gas chamber between said pump and said flexible bladder.

15. The groundwater sampling apparatus of claim 13 wherein said packer comprises:

a packer body secured to said pump, said packer body defining a fluid inlet passage extending completely through said packer body, said fluid inlet passage being in communication with said inlet of said pump and with said portion of said groundwater in said well; and a flexible bladder sealingly attached to said packer body, said flexible bladder defining a gas chamber between said packer body and said flexible bladder.

16. The groundwater sampling apparatus of claim 13 wherein said packer comprises:

a hollow cylindrical tube fixedly attached to said inlet of said pump, said hollow cylindrical tube fixedly attached to said inlet of said pump, said hollow cylindrical tube having a plurality of holes extending completely through said cylindrical tube, said inlet of said pump being in communication with said portion of said groundwater in said well through said plurality of holes when said pump is submerged in said groundwater;

a packer body fixedly secured to said cylindrical tube; and a flexible bladder sealingly attached to said packer body, said flexible bladder defining a gas chamber between said packer body and said flexible bladder.

* * * * *

UNITED STATES PATENT AND TRADEMARK OFFICE

CERTIFICATE OF CORRECTION

PATENT NO. : 5,238,060

DATED : August 24, 1993

INVENTOR(S) : K. Lynn Nichaus et al.

It is certified that error appears in the above-identified patent and that said Letters Patent is hereby corrected as shown below:

ON THE TITLE PAGE, after "Assignee:", "OED" should be --QED--.

Column 3, line 48, after "to", insert --a--.

Column 5, line 23, "and" should be --an--.

Column 5, line 50, "correspondly" should be --correspondingly--.

Column 5, line 63, "teflon" should be --Teflon®.

Column 7, line 67, "supply" should be --supplying--.

Column 8, line 8, claim 3, after "; and", begin new paragraph.

UNITED STATES PATENT AND TRADEMARK OFFICE

CERTIFICATE OF CORRECTION

PATENT NO. : 5,238,060

DATED : August 24, 1993

INVENTOR(S) : K. Lynn Nichaus et al

It is certified that error appears in the above-indentified patent and that said Letters Patent is hereby corrected as shown below:

Column 8, line 8, claim 3, "sealing" should be --sealingly --.

Column 10, line 24, claim 9 "," should be --; --.

Signed and Sealed this

Twenty-sixth Day of July, 1994

Bruce Lehman

*Attest:*

BRUCE LEHMAN

*Attesting Officer*

*Commissioner of Patents and Trademarks*